United States Patent [19]

Wu

[11] Patent Number: 5,069,649

[45] Date of Patent: Dec. 3, 1991

[54] TOY POLICE CAR WITH A RETRACTABLE HELICOPTER

[76] Inventor: Hai M. Wu, No. 630, An Ping Rd., Tainan, Taiwan

[21] Appl. No.: 615,139

[22] Filed: Nov. 19, 1990

[51] Int. Cl.[5] ..... A63H 17/25; A63H 5/00; A63H 17/00; A63H 17/26

[52] U.S. Cl. ..... 446/288; 446/409; 446/435; 446/470

[58] Field of Search ..... 446/288, 269, 279, 280, 446/281, 282, 308, 309, 310, 404, 409, 414, 435, 465, 470, 471, 487, 484, 485

[56] References Cited

U.S. PATENT DOCUMENTS

| | | | |
|---|---|---|---|
| 4,435,916 | 3/1984 | Iwao et al. | 446/470 |
| 4,465,949 | 8/1984 | Knauff | 446/409 X |
| 4,504,239 | 3/1985 | Kuleszsa et al. | 446/435 X |
| 4,623,320 | 11/1986 | Kakizaki et al. | 446/435 X |
| 4,654,018 | 3/1987 | Farrington et al. | 446/310 X |
| 4,681,554 | 7/1987 | Hsien-Yang | 446/470 X |

FOREIGN PATENT DOCUMENTS

| | | | |
|---|---|---|---|
| 959170 | 2/1957 | Fed. Rep. of Germany | 446/435 |
| 2025531 | 5/1970 | Fed. Rep. of Germany | 446/409 |
| 2625446 | 7/1989 | France | 446/409 |
| 606806 | 7/1960 | Italy | 446/409 |

*Primary Examiner*—David N. Muir

*Attorney, Agent, or Firm*—Fitch, Even, Tabin & Flannery

[57] ABSTRACT

A toy police car includes a two-level cam, a sound assembly, a signal control assembly, a projection assembly, and a helicopter. The two-level cam includes an upper cam and a lower cam and is driven indirectly by an electric motor and a series of gears. The upper cam drives the projection assembly to project toy figures out of the car doors and a return spring causes the toy figures to return to their original position. The lower cam urges a push rod which controls the upward movement of the helicopter and another return spring causes the helicopter to return to its original position. The sound assembly is activated by the push rod to generate several sound effects. Another cam, indirectly driven by the motor, impinges an activation arm to control signal lights.

1 Claim, 9 Drawing Sheets

TOY POLICE CAR WITH A RETRACTABLE HELICOPTER

BACKGROUND OF THE INVENTION

The present invention relates to a toy police car with a retractable helicopter, and more particularly, to a toy police car having a two-level cam in which a lower cam thereof controls the movement of the retractable helicopter and an upper cam thereof controls the projection of two toy policemen out from the windows to fire upon a hypothetical criminal.

Applicant's U.S. Pat. No. 4,925,927 discloses a convertable toy car having a two-level cam to control the automatic projection of two-policemen out from the windows to fire upon a hypothetical criminal. The present invention further provides a retractable helicopter, also controlled by the two-level cam, for an additional amusement effect.

SUMMARY OF THE INVENTION

It is an object of the present invention to provide a toy police car with a two-level cam which comprises a lower cam to control the movement of a retractable helicopter and an upper cam to control the projection of two toy policemen out from the windows to fire upon a hypothetical criminal.

This and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
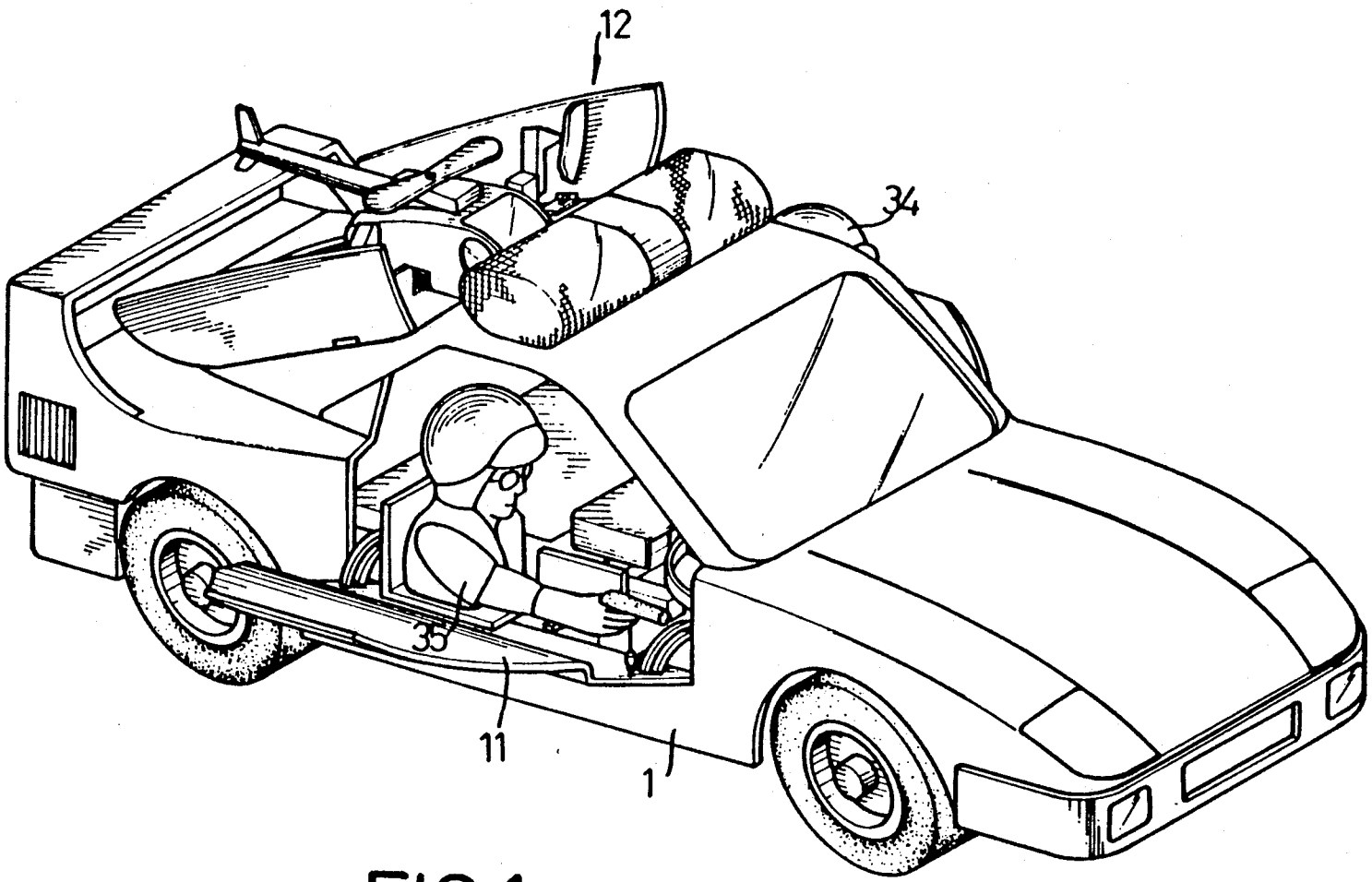
FIG. 1 is a perspective view of a toy police car in accordance with the present invention.
Figure 2:
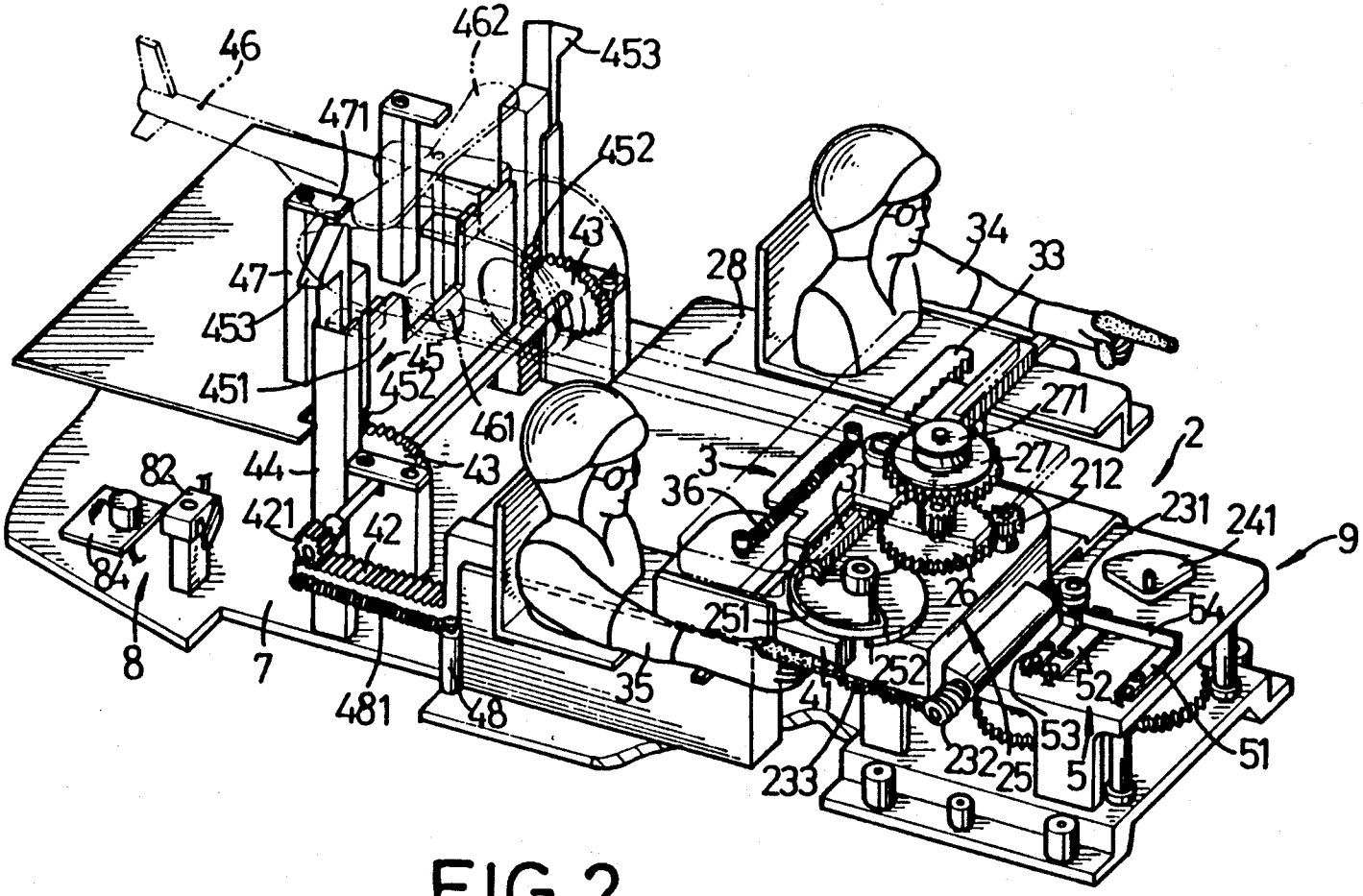
FIG. 2 is a perspective view showing the arrangement of the toy police car with an outer body thereof removed.

Referring to FIGS. 1 and 2, it can be understood that the toy police car of the present invention includes an outer body 1, a floor plate 7, a mounting assembly 9 on the floor plate 7, a battery-driven electric motor 21, a transmission assembly 2, a sound assembly 8, a two-level cam 25, a second cam 241, a signal light controlling assembly 5, a projection assembly 3, and a retractable helicopter 46.

The transmission assembly 2 is disposed on the mounting assembly 9 in a front portion of the outer body 1 and the projection assembly 3 is disposed at the rear of the transmission assembly 2. At the rear portion of the outer body 1 there is provided a helicopter 46 under a roof 12 which will be discussed in detail later.

Figure 3:
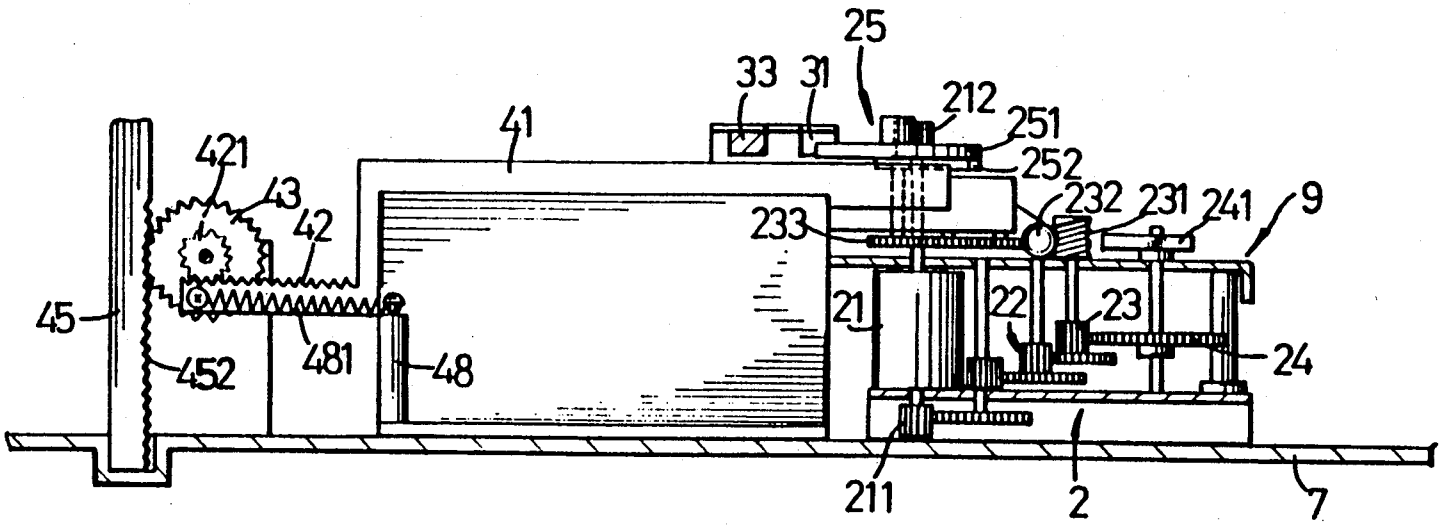
FIG. 3 is a schematic side view of the toy police car of FIG. 2 showing the transmission assembly.

Referring to FIGS. 2 and 3, a motor 21 drives an upper gear 212 and a lower 211. The upper gear 212 engages with a gear 26, which in turn meshes with another gear 27, above the latter of which a coaxial pulley 271 is provided. The lower gear 211 turns a set of gears 22 to rotate a gear 23. A worm gear 231, coaxial with gear 23, turns three engaged pinions 233 in which the leftmost pinion 233 is coaxial with the two-level cam 25. Both the lobes of the upper cam 251 and of the lower cam 252 of the two-level cam 25 have a sector-like configuration. Gear 23 also turns a gear 24 which is coaxial with a second cam 241.

Adjacent to the second cam 241 is the signal light controlling assembly 5. The signal light controlling assembly 5 includes three spaced copper plates 51, 52, and 53 fixed on the mounting assembly 9 and connectable to it with an activating arm 54 whose one end is fixedly attached to plate 51. Referring to FIG. 3, if the second cam 241 does not engage with the activating arm 54, plate 51 electrically connects with plate 52, thereby lighting two signal lights (not shown). On the other hand, if the second cam 241 does engage with the activating arm 54, plate 54 electrically connects with plate 53, thereby lighting an alternative set of two signal lights (not shown). The signal lights provide a visual esthetical effect.

The projection assembly 3 is disposed at the rear of the two-level cam 25. The projection assembly 3 includes a left arm 31, a right arm 33, and a motion transfer gear 32. The motion transfer gear 32 is rotatably fixed between the left and right arms 31 and 33. Each of the arms 31 and 33 have teeth (not labeled) on mutually facing sides thereof which are engaged with the motion transfer gear 32 such that when the left arm 31 moves outward, the right arm 33 moves outward, and when the left arm 31 moves inward, the right arm 33 moves inward.

The teeth of the left arm 31 are engageable with the upper cam 251 and are retracted by a return spring 36 when not engaging with the upper cam 251. The upper cam 251 intermittently drives the left arm 33, thereby causing two toy policemen 34 and 35 to move outward. As soon as the upper cam 251 disengages from the left arm 31, the return spring 36 moves the two toy policemen 34 and 35 inward. The operation and structure of the two-level cam and the projection assembly are clearly described in Applicant's U.S. Pat. No. 4,925,427, such that no further explanation is here required.

Still referring to FIGS. 2 and 3, a push rod 41 has a first end extending to a place adjacent to the two-level cam 25, such that the push rod 41 can be displaced by the lower cam 252. The second end of the push rod 41 is substantially a rack 42 whose teeth face upward. A second return spring 481 is attached to the rack 42 at one end, the other end is fixed to the floor plate 7 at 48. Rack 42 is engaged with a pinion 421 which is coaxial with two gears 43. At the rear of each gear 43 there is provided a U-shaped fixed member 44 which receives a movable member 45. A central fixing member 451 lies between, fixed to the two movable members 45.

The helicopter 46 is mounted on the central fixing member 451 under the roof 12. The roof is composed of two L-shaped plates 13 pivotally mounted on the outer body 1. The helicopter 46 has blades 462 which are driven by a pulley 461 disposed thereunder. Pulley 461 is connected to the blades 462 by a shaft (not labeled) and connected to pulley 271 by an endless belt 28. The front surfaces of the movable members 45 are formed into a rack so as to engage with gears 43. A hook member 453 is formed on the top of both of the movable members 45. In addition, a post 47, with a height restraining member 471 mounted on a top thereof, is disposed at the rear of the central fixing member 451. The sound assembly 8, disposed at the rear of the rack 42, includes a switch 82 and an integral circuit plate 491 electrically connected with the switch 82.

Figure 4:
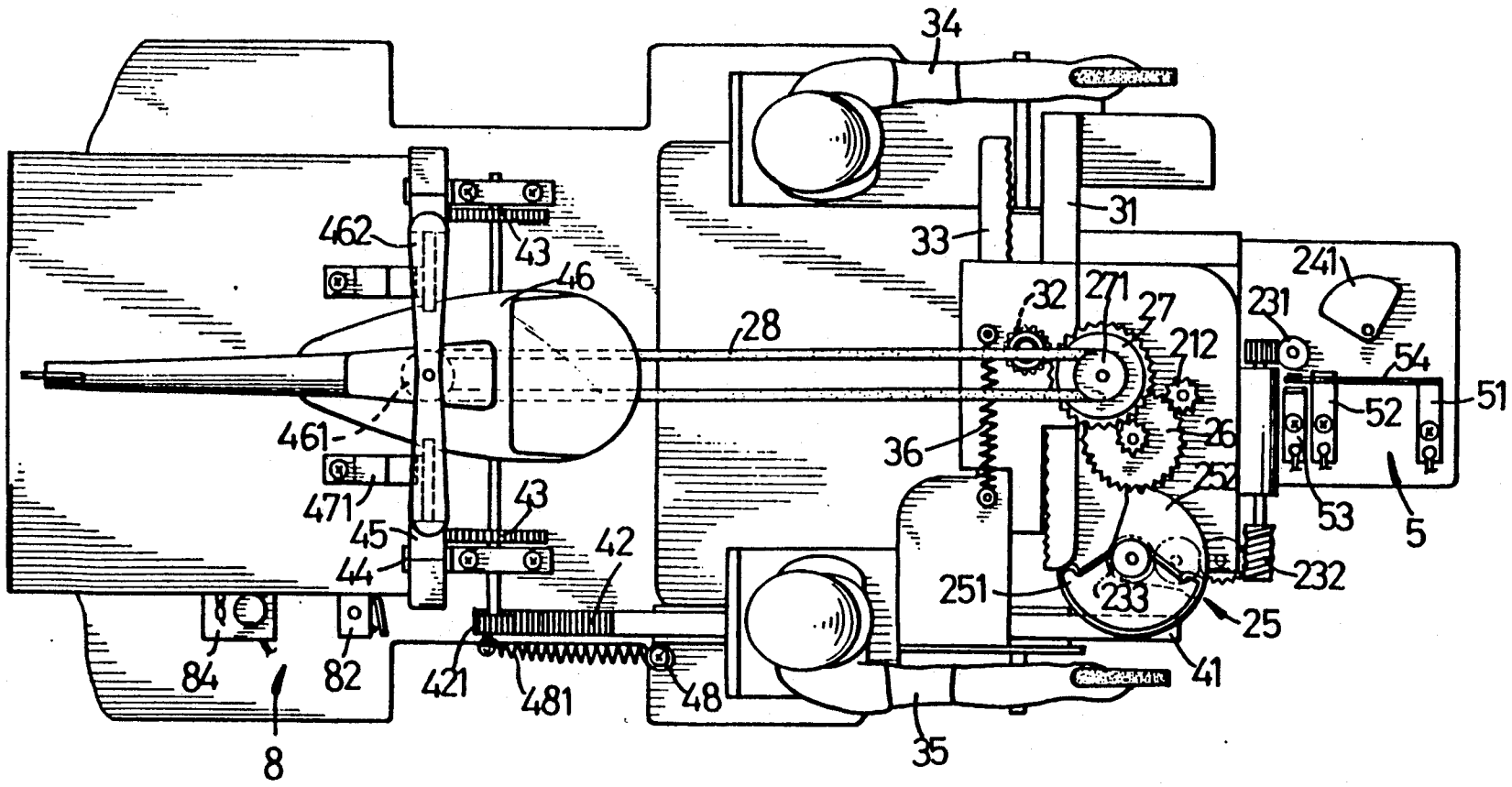
FIG. 4 is a top view of the toy police car of FIG. 2, with the projection assembly in an unextended position and the helicopter in an retracted position.

Referring to FIGS. 2 through 9, it can be seen that pulley 271, the two-level cam 25, and the second cam 241 are driven by the motor 21. Pulley 271 turns the blades 462 via the belt 28 and pulley 461. The second cam 241 intermittently impinges on the activating arm 54, thereby intermittently turning on and off the signal lights. When the two-level cam 25 starts to turn, as shown in FIG. 4, the upper cam 251 begins to engage with the left arm 31 while, at the same time; the lower cam 252 has yet to engage with the push rod 41.

Figure 5:
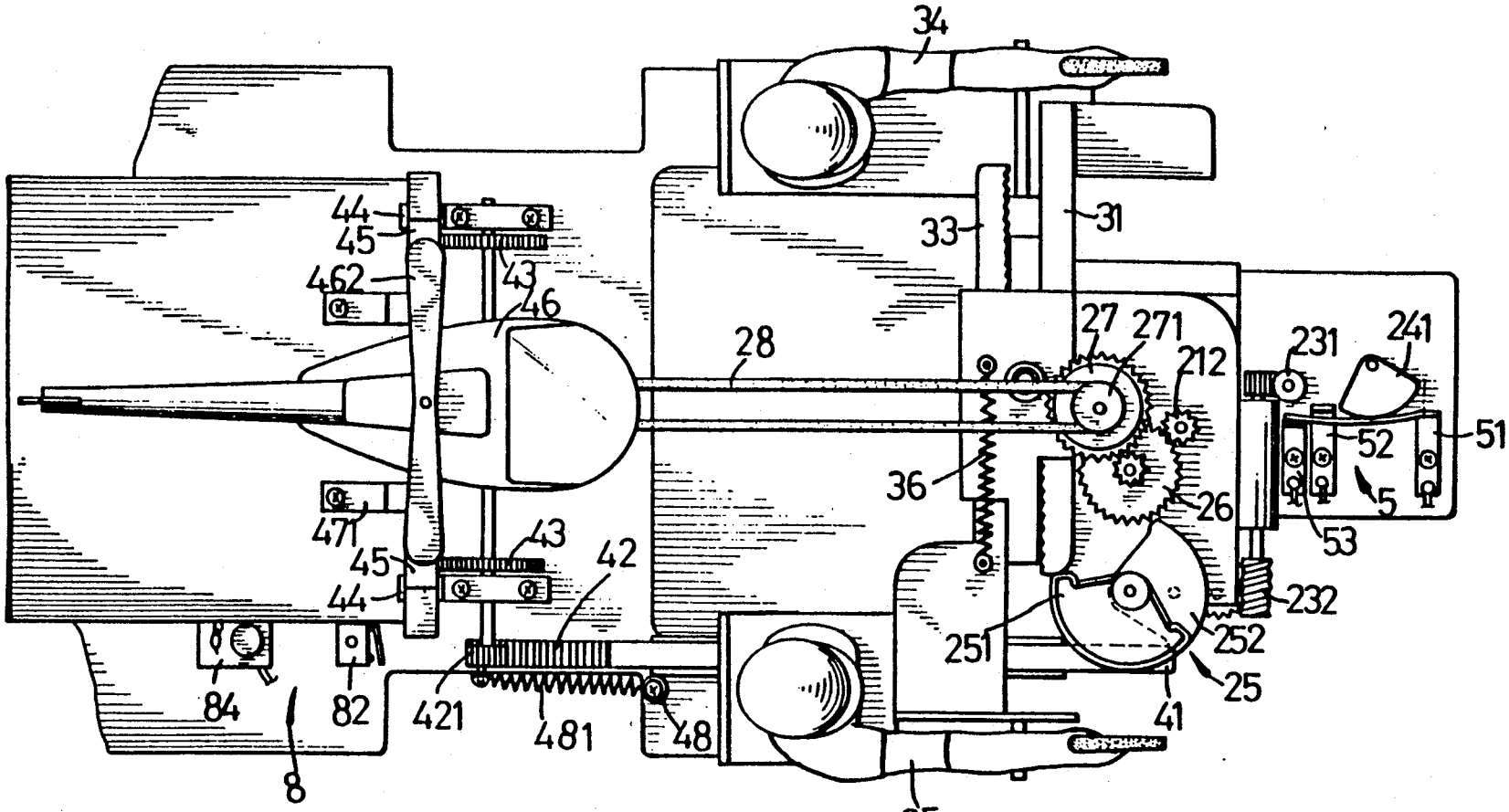
FIG. 5 is a top view of the toy police car of FIG. 2, with the projection assembly in an extended position and the helicopter in the retracted position.
Figure 6:
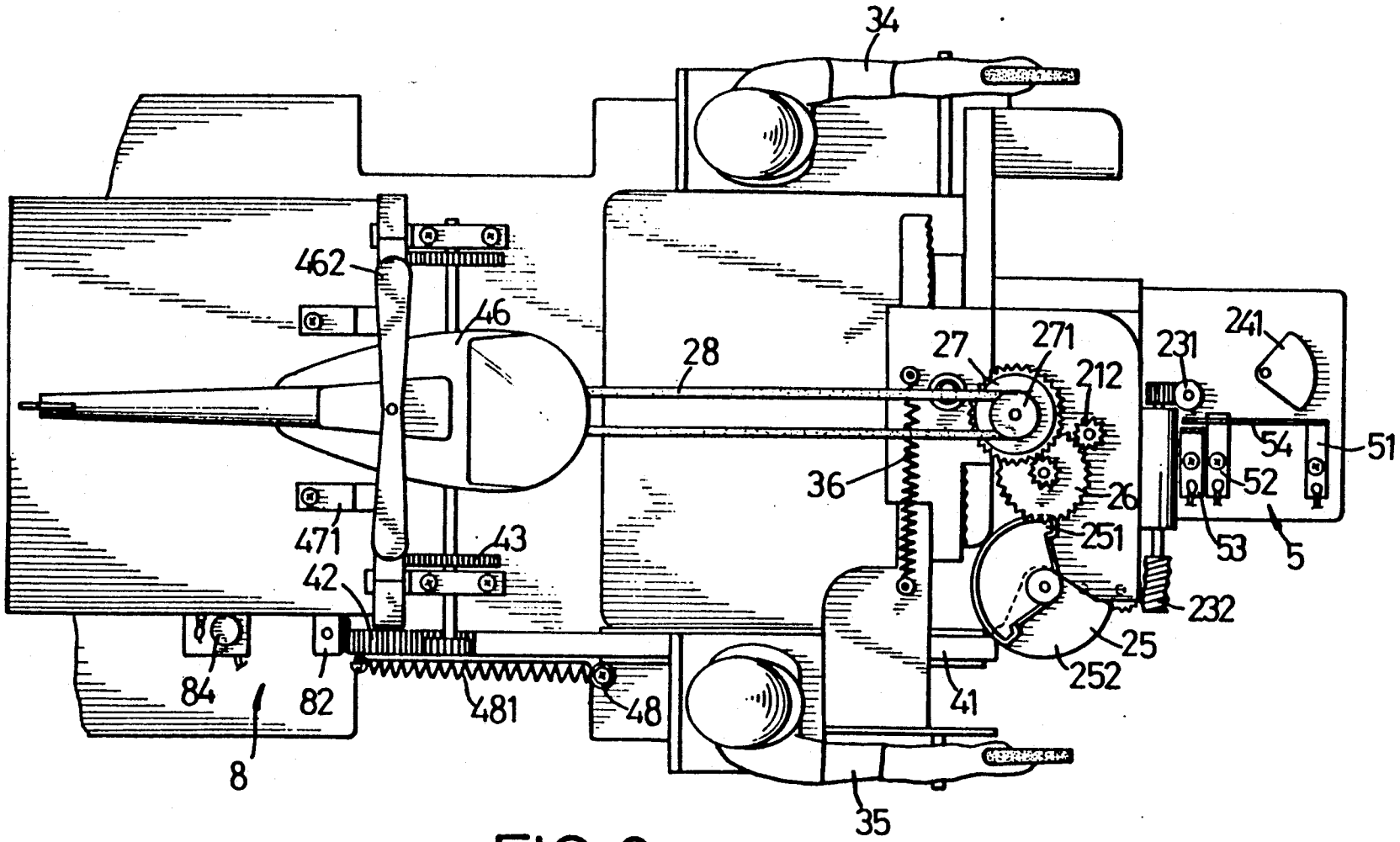
FIG. 6 is a top view of the toy police car of FIG. 2, with both the projection assembly and the helicopter in the extended position.
Figure 7:
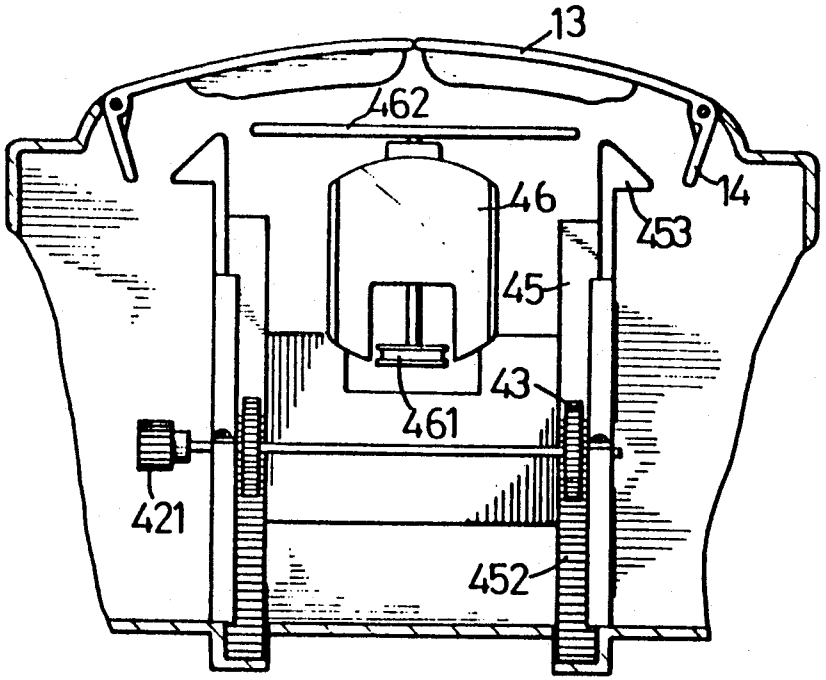
FIG. 7 is an elevational view wherein the fixing member has not moved upward yet, and the helicopter remains in the car.
Figure 8:
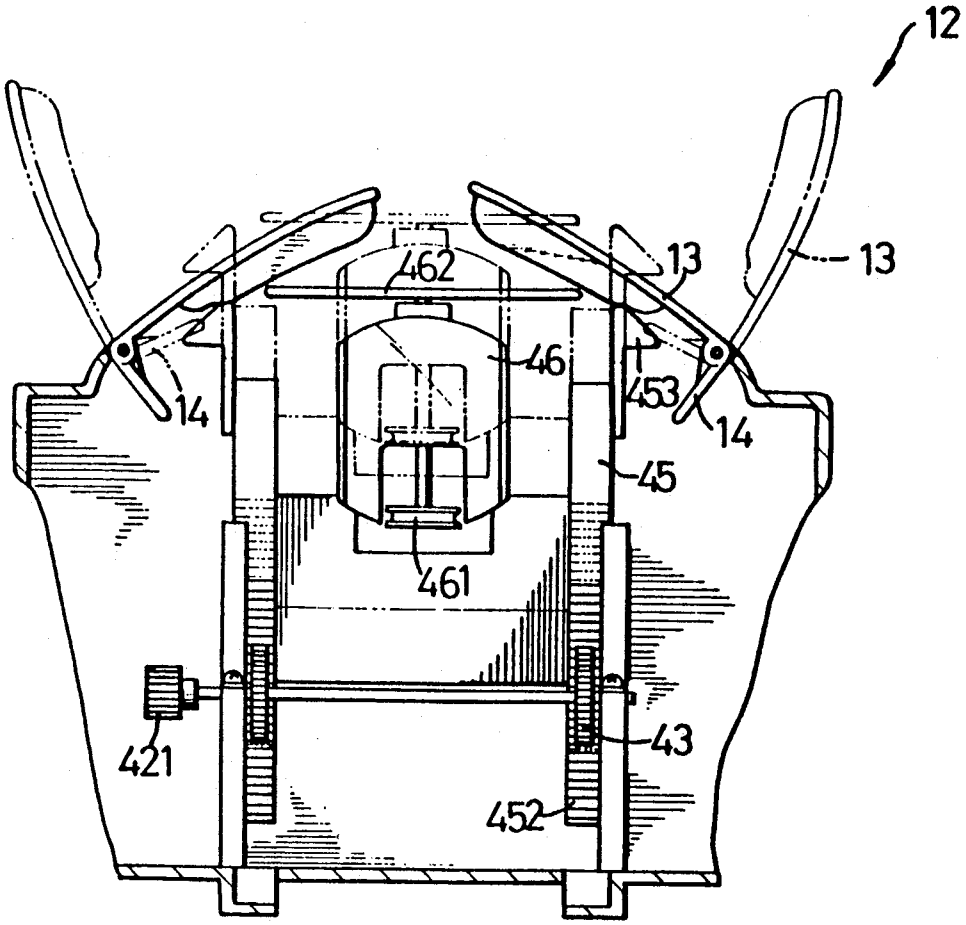
FIG. 8 is an elevational view similar to FIG. 7, wherein the fixing member has moved upward to open the roof in the rear portion of the car in order to allow upward movement of the helicopter.
Figure 9:
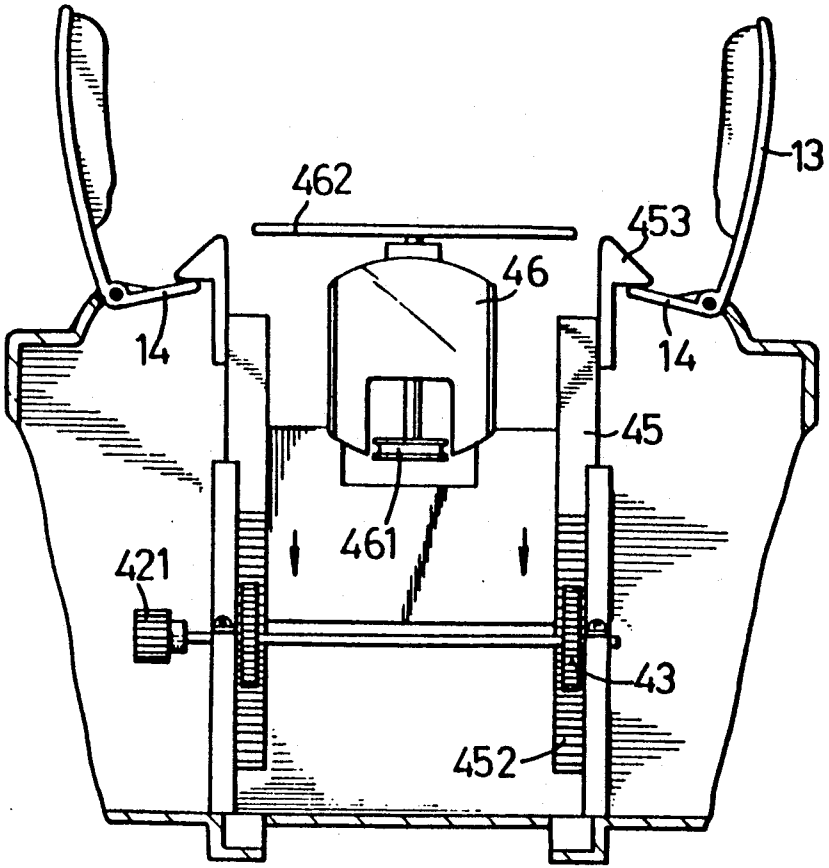
FIG. 9 is an elevational view similar to FIG. 7, wherein the fixing member, together with the helicopter, is moved downward while the door is simultaneously closed.

FIG. 5 shows that rotation of the upper cam 251 causes the left arm 31, together with the two toy policemen 34 and 35, to move outward, and further rotation causes the lower cam 252 to displace the push rod 41. From this point, the upper cam 251 forces the two toy policemen 34 and 35 to move outward and the lower cam 252 forces the helicopter 46 to move upward to a status shown in FIG. 6. Referring to FIG. 8, the lower cam 252, via rack 42, pinions 421, gears 43, and rack 452, cause the helicopter 46 to move upward such that the central fixing member 451 and the helicopter 46 are lifted until stopped by the height restraining member 471, while the switch 82, actuated by rack 42, initiates sound effects such as that of a police car, guns, and helicopter, generated under the control of the IC plate 84. The two-level cam 25 keeps turning such that when the upper cam 251 disengages with the left arm 31, return spring 36 moves the projection assembly 3 back to its original position. Similarly, when the lower cam 252 disengages with rack 42, return spring 481 pulls the push rod 41 forward such that the switch 82 is no longer actuated and the helicopter 46 moves downward. In addition, when the helicopter 46 moves downward, the hook member 453 on the movable member 45 impinges on a hook plate 14 of the L-shaped plates 13, thereby closing the roof 12.

As various possible embodiments might be made of the above invention without departing from the scope of the invention, it is to be understood that all matter herein described or shown in the accompanying drawing is to be interpreted as illustrative only, not to be taken in a limiting sense. Thus it should be appreciated that the drawings exemplify this preferred embodiment of the invention, but are not in any sense the only embodiment.

I claim:

1. In a toy police car or the like with an outer body, a floor plate, a mounting assembly on the floor plate, a battery-driven electric motor, a transmission assembly mounted on the mounting assembly, a sound assembly, a two-level cam consisting of an upper cam and a lower cam, and a projection assembly controlled by the upper cam to control intermittent projection of two toy policemen out from the car, the improvements comprising:

a push rod intermittently displaced by said lower cam at a first end thereof, a second end of said push rod being substantially a rack whose teeth face upward;

a return spring attached to said rack at one end thereof and fixed to the floor plate at a second end thereof;

a pinion engaging with said rack and being coaxial with two gears, a U-shaped fixed member being provided at a rear of each said gear for receiving a movable member, a central fixing member lying between and being fixed to said two movable members;

a roof consisting of two L-shaped plates pivotally mounted at a rear portion of the outer body;

a helicopter mounted on said central fixing member under said roof, said helicopter having blades driven by a pulley disposed thereunder, said pulley being connected to said blades by a shaft and connected to a second pulley by an endless belt, said second pulley being drivable by said motor via a series of gears, a front surface of said movable members being formed into teeth such as to engage with said gears, a hook member being formed on a top of both of said movable members, a height restraining member being mounted adjacent to said central fixing member; and said helicopter moving upward out from said roof and biasing said return spring under intermittent activation of said lower cam on said push rod until being stopped by said height restraining member, said helicopter moving downwardly by said return spring when said lower cam disengaging with said activating rod, and said hook members of said movable members impinging on said L-shaped plates, thereby closing said roof during the downward movement of the helicopter.

* * * * *

UNITED STATES PATENT AND TRADEMARK OFFICE

CERTIFICATE OF CORRECTION

PATENT NO. : 5,069,649

DATED : December 3, 1991

INVENTOR(S) : Hai Ming WU

It is certified that error appears in the above-identified patent and that said Letters Patent is hereby corrected as shown below:

On the title page,

Under [56] References Cited, in U.S. Patent No. 4,504,239, change "Kuleszsa et al." to --Kulesza et al.--.

Column 1, line 13, change "4,925,927" to --4,925,427--.

Column 2, line 12, after "lower" insert --gear--.

Signed and Sealed this

Sixth Day of April, 1993

*Attest:*

*Attesting Officer*

STEPHEN G. KUNIN

*Acting Commissioner of Patents and Trademarks*